US005141010A

United States Patent [19]

Muller et al.

[11] Patent Number: 5,141,010

[45] Date of Patent: Aug. 25, 1992

[54] AUTOMATIC UMBRELLA

[75] Inventors: Richard J. Muller; Milton P. Chernack, both of New York, N.Y.

[73] Assignee: Richard Muller, New York, N.Y.

[21] Appl. No.: 764,798

[22] Filed: Sep. 24, 1991

[51] Int. Cl.[5] ..... A45B 11/00

[52] U.S. Cl. ..... 135/20.3; 135/22; 135/24

[58] Field of Search ..... 135/20.3, 22, 23, 24, 135/15.1, 41

[56] References Cited

U.S. PATENT DOCUMENTS

| | | | |
|---|---|---|---|
| 737,787 | 9/1903 | Shepherd | 135/43 |
| 1,109,854 | 9/1914 | McCabe | 135/22 |
| 2,224,882 | 12/1940 | Peck | 135/20.3 X |
| 3,129,715 | 4/1964 | Militano et al. | 135/20.3 |
| 3,258,021 | 6/1966 | Tartaglia | 135/43 |
| 4,011,881 | 3/1977 | Becher | 135/20.3 |
| 4,319,600 | 3/1982 | Roche | 135/20.3 |
| 4,523,601 | 6/1985 | Grady et al. | 135/24 X |
| 4,572,226 | 2/1986 | Williams et al. | 135/22 |

FOREIGN PATENT DOCUMENTS

| | | | |
|---|---|---|---|
| 21702 | of 1902 | United Kingdom | 135/28 |

*Primary Examiner*—David A. Scherbel
*Assistant Examiner*—Lan Mai
*Attorney, Agent, or Firm*—Cohen, Pontani, Lieberman & Pavane

[57] ABSTRACT

An automatic open and close umbrella, that has an umbrella canopy, a hollow shaft, a driven member which is driven by means of a threaded drive shaft and has at least one radial spline extending through an axial slot in the wall of the hollow shaft, and a handle located at the proximate end of the hollow shaft containing a drive motor which powers a threaded drive shaft to drive the driven member along the hollow shaft, incorporates a manual override mechanism to engage and disengage the drive motor to manually operate the driven member along the hollow shaft to open and close the umbrella.

2 Claims, 4 Drawing Sheets

FIG. 7
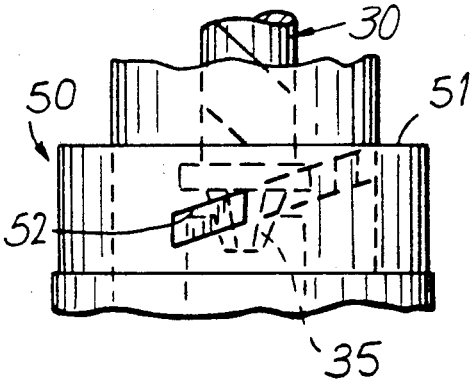
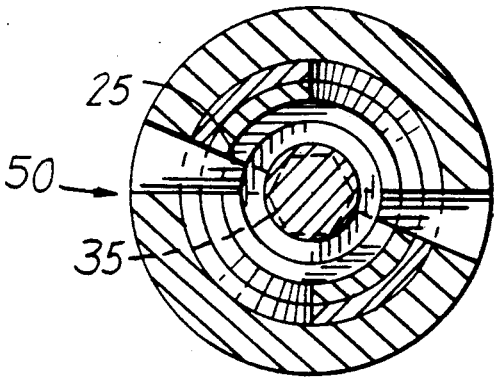
FIG. 8
FIG. 9
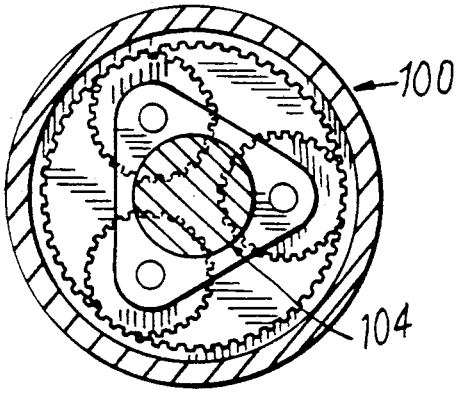
FIG. 10
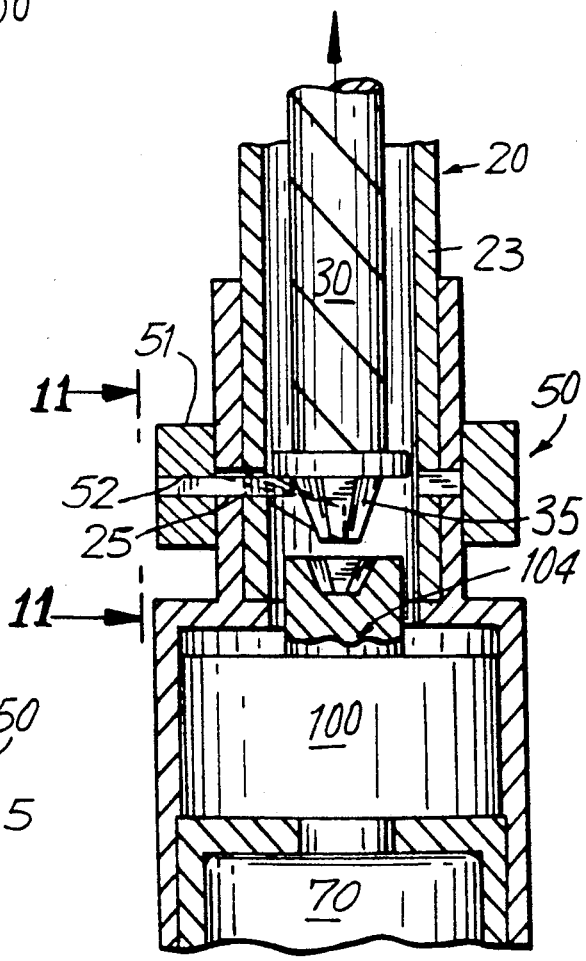
FIG. 11
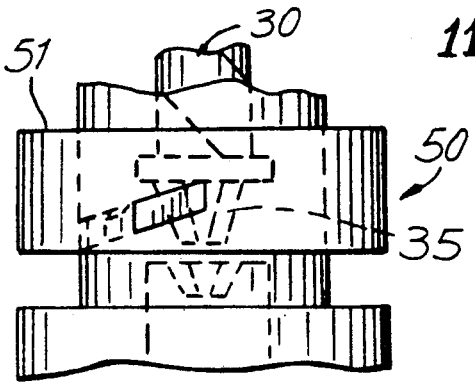

AUTOMATIC UMBRELLA

FIELD OF THE INVENTION

The present invention relates to an umbrella that opens and closes automatically by means of a driven member, a threaded drive shaft and a drive motor and which can be manually operated by disengaging the threaded drive shaft from the drive motor by means of a manual override mechanism.

BACKGROUND OF THE INVENTION

U.S. Pat. No. 4,572,226 describes a push button automatic open and close umbrella that operates by a drive motor and a drive mechanism and has a manual override device. The umbrella's drive mechanism operates by means of a motor which drives rods to rotate a drum along a stationary threaded split shaft to operate a runner. Its manual override device incorporates two spring biased arms each having a contact member to compress the stationary threaded split shaft to disengage the threads of the split shaft from the drum. However, the split shaft design is difficult to manufacture and can yield during operation in high wind conditions, for example. Thus, a major disadvantage of this design is that the repeated coupling and uncoupling of the split shaft threads from threads of the driven member which supports the canopy of the umbrella will tend, in time, to cause excessive wear of the threads with consequent slippage, further wear and eventual breakdown. Accordingly, there is a need for a drive mechanism that is relatively easy to manufacture and is more durable than the split shaft design heretofore described.

SUMMARY OF THE INVENTION

The invention addresses the need for ease of manufacture and durability in an automatic open and close umbrella which comprises a canopy, a hollow shaft with a proximal end, a distal end and a longitudinal axis having side walls defining at least one axial slot extending through the hollow shaft, a threaded drive shaft located within the hollow shaft and a driven member which rides along the threaded drive shaft when the drive shaft is rotated. The driven member has a sleeve, a radial spline and an internal threaded section. The sleeve is slidably mounted on the hollow shaft and is connected to at least one radial spline which extends through at least one axial slot in the wall of the hollow shaft. The radial spline connects the internal threaded section to the external sleeve. The internal threaded section is mounted in threaded engagement with the drive shaft. The umbrella further includes a handle attached to the proximal end of the hollow shaft, a forward and reverse drive motor located inside the handle, and a manual override mechanism located between the drive motor and the drive shaft which manually engages and disengages the drive motor from the drive shaft.

The canopy, which is attached to the distal end of the hollow shaft and is supported by extendible ribs attached to the sleeve of the driven member, is opened or closed when the sleeve of the driven member is axially displaced longitudinally along the drive shaft thereby extending or retracting the ribs supporting the canopy.

Additionally, the operator may manually open the umbrella canopy by pushing the sleeve of the driven member upward longitudinally along the drive shaft. To close the umbrella canopy, the operator may use the manual override mechanism to disengage the spline of the drive shaft from the spline socket in order to pull the sleeve of the driven member downward to close the canopy. Thus, the manual override mechanism permits the operator to utilize the umbrella either automatically or manually depending on the conditions presented to the user.

It is thus an object of the present invention to provide an improved drive mechanism for automatically opening and closing an umbrella.

A further object of this invention is to provide a manual override mechanism to easily engage and disengage the drive shaft from the drive motor to allow for manually opening and closing the umbrella.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views:

FIG. 7 is a front plan view of the manual override mechanism in the proximal end of the umbrella;

FIGS. 8 and 9 are top cross-sectional views of the manual override mechanism taken along lines 8—8 and 9—9, respectively, in FIG. 6;

FIG. 10 is a front cross-sectional view of the drive shaft of the umbrella disengaged from the drive motor in the proximal end of the umbrella; and FIG. 11 is a front plan view of the manual override mechanism.

DETAILED DESCRIPTION OF THE PRESENTLY PREFERRED EMBODIMENTS

Figures 1, 2:
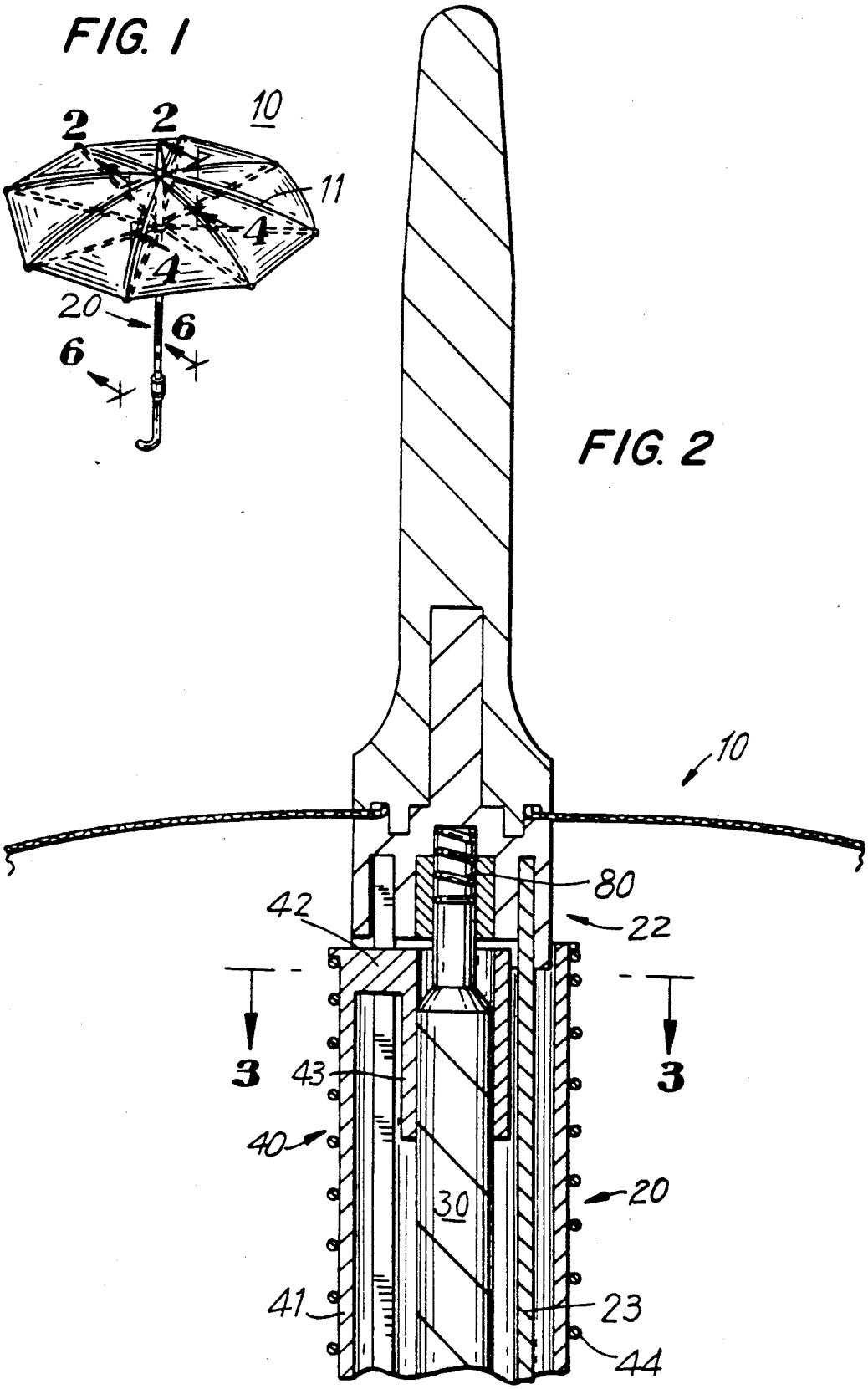
FIG. 1 is a perspective view of an umbrella in accordance with the present invention.
FIG. 2 is a sectional view of the base portion of the distal end of the umbrella of FIG. 1.

FIG. 1 shows umbrella canopy 10 in an open position supported by extendible ribs 11. The umbrella further includes a hollow shaft 20 and a handle 60. As used herein the "proximal end" of the umbrella shall refer to the handle end, whereas the term "distal end" shall refer to the location of the canopy.

FIG. 2 shows the distal end of the umbrella. A driven member 40 is slidably mounted on the hollow shaft 20. The driven member 40 includes a sleeve 41 which encircles a portion of the hollow shaft 20. The driven member 40 further includes an internal threaded section which is located within the hollow shaft 20. One or more radial splines 42 connect the sleeve 41 to the internal threaded section 43. Within the hollow shaft 20 there also is a drive shaft 30. The drive shaft 30 has threads which engage with the internal threaded section 43 so that when the drive shaft 30 is rotated, the driven member 40 is axially displaced along the hollow shaft 20. A spring 80 located at the distal end 22 of the hollow shaft 20 biases the drive shaft 30 towards the proximal end (not shown). The hollow shaft 20 has a sidewall 23 which is interrupted by one or more axial slots 24 through which the radial splines 42 project.

Figure 3:
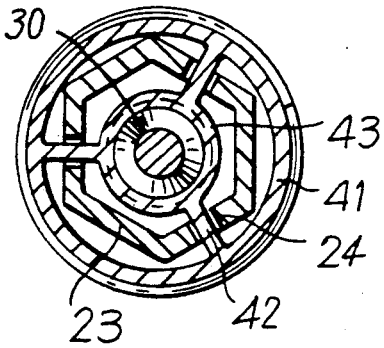
FIG. 3 is a cross-sectional view taken along line 3—3 of FIG. 2.

FIG. 3 illustrates a top cross-sectional view taken along line 3—3 in FIG. 2. A preferred embodiment is illustrated wherein the driven member 40 has three radial splines. The splines are preferably, although not necessarily, equidistant from one another.

Figure 4:
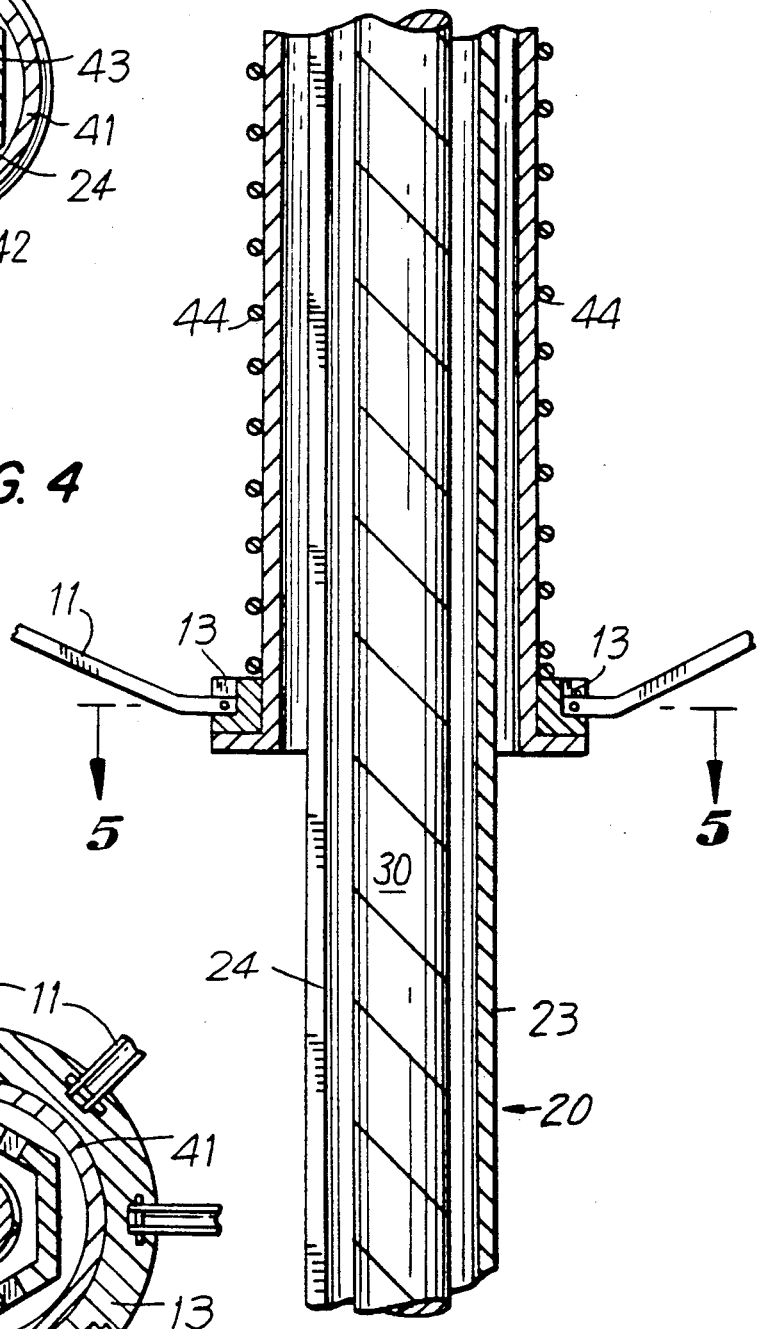
FIG. 4 is a sectional view of the umbrella of FIG. 1 midway between the proximal and distal ends thereof.

FIG. 4 illustrates a mid-portion of the umbrella. As shown, the extendible ribs 11 which support the canopy are attached to a base ring 13. The base ring 13 is supported on bottom by the sleeve 41 and is retained in place by a gust spring 44.

Figure 5:
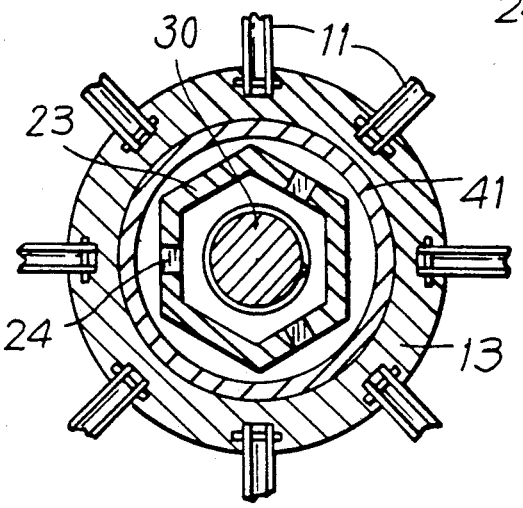
FIG. 5 is a cross-sectional view of the radial spline section of the driven member and the drive shaft taken along line 5—5 in FIG. 4.

As shown in FIG. 5, the extendible ribs 11 are pivotally attached to the base ring 13.

Figure 6:
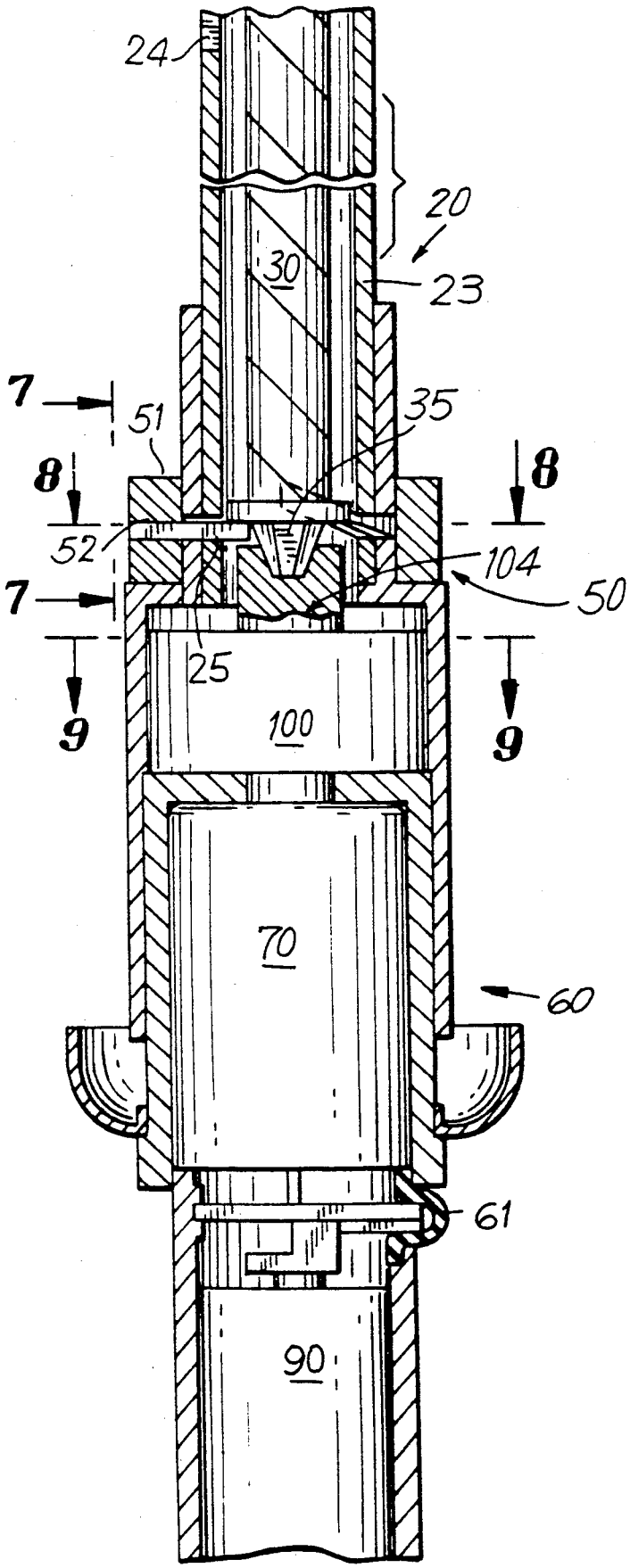
FIG. 6 is a side cross-sectional view of the proximal end of the umbrella.

FIG. 6 illustrates the proximal end of the umbrella. A handle 60 contains a small forward and reverse drive motor 70 (which in its preferred embodiment is powered by batteries 90) which is activated by a switch lever 61. The drive motor 70 powers the threaded drive shaft 30 through a spline socket 104 and gear box 100. The drive shaft 30 includes a spline 35 which engages the spline socket 104 during motor driven operation. The rotation of the drive shaft 30 displaces the driven member 40 axially up and down the drive shaft 30. A manual override mechanism 50 is provided in the proximal end of the hollow shaft 20 for displacing the spline 35 of drive shaft 30 out of the spline socket 104. When so displaced, the drive shaft 30 can freely rotate without engaging the motor 70 so that the driven member 40 can be displaced manually. The manual override mechanism 50 includes a ring 51 and one or more wedges 52. The wedge or wedges 52 project through the base slots 25 formed in the proximal end of the hollow shaft 20. The base slots 25 are inclined along the axis of the hollow shaft so that when ring 51 is rotated, the wedges 52 attached thereto are axially displaced as they follow the incline of the base slot 25. The incline of the base slots 25 and the orientation of the wedges 52 can be more readily seen in FIGS. 7, 8 and 11.

FIG. 10 illustrates the position of the drive shaft 30 when axially displaced by the operation of the manual override mechanism 50.

The operator can open or close the umbrella either automatically or manually. The canopy 10 of the umbrella can be opened and closed automatically by the driven member 40 being driven along the drive shaft 30 by a forward and reverse drive motor 70. Additionally, the umbrella canopy 10 can be manually opened without using the drive motor 70 by simply pushing or displacing the sleeve 41 of the driven member 40 longitudinally upward to open the canopy 10. By manually pushing or displacing the sleeve 41 of the driven member 40 longitudinally upward along the drive shaft 30, the vertical force applied by the user overcomes the normal urgency of the bias spring 80, thereby displacing the spline 35 of the drive shaft 30 from the spline socket 104 which is driveably connected to the motor 70. To manually close the umbrella, the ring 51 of the manual override mechanism 50 must first be rotated so as to disengage the spline 35 of the drive shaft 30 from the spline socket 104 and thereby enable the sleeve 41 of the driven member 40 to be pulled or displaced downwardly for retracting the extendible ribs of the umbrella and thus closing the canopy 10. The ring 51 must then be re-rotated to reengage the spline 35 of the drive shaft with the spline socket 104 to prepare the umbrella for subsequent use. This functionality allows the umbrella to be manually operated by the operator in a quick and efficient manner.

It will be appreciated, that in the design of the present invention, contact is always maintained between the threads of the drive shaft 30 and the internal threaded section 43 of the driven member 40. As such, this design reduces the wear on the threads and maintains a better hold of the driven member 40 when, during high wind conditions, etc., such control is beneficial. The novel manual override mechanism in accordance with the invention permits this disengagement of the drive shaft 30 from the motor 70 without compromising the threaded interrelationship between the drive shaft and the driven member. The described invention accomplishes the aforementioned objects with a minimum of moving parts that results in ease of manufacture, simplicity of operation, lower weight and increased durability.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. An automatic open and close umbrella, comprising:

a) a canopy supported by extendible ribs;

b) a hollow shaft having a side wall which defines at least one axial slot extending therethrough, said shaft having a proximal end and a distal end and a longitudinal axis;

c) a threaded drive shaft which is located within the hollow shaft, said threaded drive shaft extending along the longitudinal axis of said hollow shaft;

d) a driven member, said driven member having a sleeve located along the outside perimeter of a section of the hollow shaft and surrounding the hollow shaft; said sleeve connected to at least one radial spline, said radial spline extending through the axial slot in said wall of said hollow shaft; said radial spline connected to an internal threaded section which is mounted on said threaded drive shaft located inside said hollow shaft for axial displacement longitudinally along said threaded drive shaft when said threaded drive shaft is rotated and for preventing rotation of the internal threaded section when said threaded drive shaft is rotated;

e) a handle which is attached to the proximal end of said hollow shaft;

f) a forward and reverse drive motor located in said handle;

g) a manual override mechanism located between said drive motor and said drive shaft, said manual override mechanism including means for manually engaging and disengaging said drive motor from said drive shaft; and h) means for connecting said sleeve of said driven member to said extendible ribs of said canopy for opening and closing said canopy in response to longitudinal axial displacement of said driven member along said drive shaft; said canopy being attached to said hollow shaft at the distal end of said hollow shaft.

2. The automatic open and close umbrella in accordance with claim 1, wherein said manual override mechanism comprises a circular rotatable release ring located on the outside wall of the hollow tubular shaft and above the distal end of said handle of said umbrella; said release ring containing rotating wedges equidistantly located on the inside wall of the hollow tubular shaft which correspond to wedge slots; said wedge slots being indentations located within the inside wall of the hollow tubular shaft.

* * * * *